US011118866B2

(12) United States Patent
Suk

(10) Patent No.: US 11,118,866 B2
(45) Date of Patent: Sep. 14, 2021

(54) APPARATUS AND METHOD FOR CONTROLLING STRIKING APPARATUS AND REMOTE CONTROLLED WEAPON SYSTEM

(71) Applicant: HANWHA DEFENSE CO., LTD., Changwon-si (KR)

(72) Inventor: Bong Kyung Suk, Changwon-si (KR)

(73) Assignee: HANWHA DEFENSE CO., LTD., Changwon-si (KR)

( * ) Notice: Subject to any disclaimer, the term of this patent is extended or adjusted under 35 U.S.C. 154(b) by 156 days.

(21) Appl. No.: 16/659,836

(22) Filed: Oct. 22, 2019

(65) Prior Publication Data

US 2020/0124381 A1 Apr. 23, 2020

(30) Foreign Application Priority Data

Oct. 22, 2018 (KR) ..... 10-2018-0125841

(51) Int. Cl.
*F41G 5/14* (2006.01)
*F41G 3/16* (2006.01)

(52) U.S. Cl.
CPC ..... *F41G 5/14* (2013.01); *F41G 3/165* (2013.01)

(58) Field of Classification Search
CPC ..... F41G 5/14; F41G 3/165; F41G 3/20
USPC ..... 235/400, 404
See application file for complete search history.

(56) References Cited

U.S. PATENT DOCUMENTS

| | | | | |
|---|---|---|---|---|
| 6,499,382 | B1 | 12/2002 | Lougheed et al. | |
| 2012/0153021 | A1* | 6/2012 | Laupstad | F41G 3/14 235/404 |
| 2017/0160056 | A1* | 6/2017 | Sullivan | F41G 3/165 |
| 2019/0063882 | A1* | 2/2019 | Brockel | F41J 5/02 |
| 2020/0049455 | A1* | 2/2020 | Hamilton | G02B 23/04 |

FOREIGN PATENT DOCUMENTS

| | | | |
|---|---|---|---|
| JP | 2012-122657 | A | 6/2012 |
| KR | 10-0460522 | B1 | 12/2004 |
| KR | 10-2012-0048786 | A | 5/2012 |
| KR | 10-1471186 | B1 | 12/2014 |
| KR | 10-2018-0025577 | A | 3/2018 |

* cited by examiner

*Primary Examiner* — Paultep Savusdiphol
(74) *Attorney, Agent, or Firm* — Sughrue Mion, PLLC

(57) ABSTRACT

Provided is an apparatus for controlling a striking device. The apparatus for controlling the striking device equipped with a weapon to strike a target includes: a display unit which displays an image captured by a camera mounted on the striking device; a control unit which controls firing of the weapon; and a manipulation unit which transmits a fire signal to the control unit, wherein the control unit calculates the number of rounds of ammunition left in the striking device, calculates an accuracy rate which is a probability that the striking device will hit the target, and determines whether the target can be neutralized by considering the calculated number of rounds of ammunition left and the calculated accuracy rate for the target.

28 Claims, 12 Drawing Sheets

FIG. 5

| PRIORITY | TARGET INFORMATION | TARGET INFORMATION | DISTANCE TO TARGET | ACCURACY RATE | NUMBER OF ROUNDS OF AMMUNITION REQUIRED/ NUMBER OF ROUNDS OF ROUNDS OF AMMUNITION LEFT | DETERMINATION |
|---|---|---|---|---|---|---|
| 1 | TARGET 1 | HUMAN | 190 m | 20 % | 5/10 | SUPPRESSIBLE |

FIG. 7

| PRIORITY | TARGET INFORMATION | TARGET INFORMATION | DISTANCE TO TARGET | ACCURACY RATE | NUMBER OF ROUNDS OF AMMUNITION REQUIRED/ NUMBER OF ROUNDS OF ROUNDS OF AMMUNITION LEFT | DETERMINATION |
|---|---|---|---|---|---|---|
| 1 | TARGET 2 | TACTICAL VEHICLE | 500m | 20 % | 5/10 | SUPPRESSIBLE |
| 2 | TARGET 3 | HUMAN | 1200m | 15 % | 7.5/10 | SUPPRESSIBLE |
| 3 | TARGET 1 | ARMORED VEHICLE | 2000m | 5 % | 20/10 | NOT SUPPRESSIBLE |

FIG. 9

| PRIORITY | STRIKING DEVICE | TARGET INFORMATION | TARGET INFORMATION | DISTANCE TO TARGET | ACCURACY RATE | NUMBER OF ROUNDS OF AMMUNITION REQUIRED/ NUMBER OF ROUNDS OF ROUNDS OF AMMUNITION LEFT | DETERMINATION |
|---|---|---|---|---|---|---|---|
| 1 | STRIKING DEVICE 1 | TARGET 1 | TACTICAL VEHICLE | 200m | 10 % | 10/15 | SUPPRESSIBLE |
| 1 | STRIKING DEVICE 2 | TARGET 1 | TACTICAL VEHICLE | 200m | 20 % | 5/15 | SUPPRESSIBLE |
| 1 | STRIKING DEVICE 3 | TARGET 1 | TACTICAL VEHICLE | 200m | 5 % | 20/15 | NOT SUPPRESSIBLE |

FIG. 11

| PRIORITY | STRIKING DEVICE | TARGET INFORMATION | TARGET INFORMATION | DISTANCE TO TARGET | ACCURACY RATE | NUMBER OF ROUNDS OF AMMUNITION REQUIRED/ NUMBER OF ROUNDS OF ROUNDS OF AMMUNITION LEFT | DETERMINATION |
|---|---|---|---|---|---|---|---|
| 1 | STRIKING DEVICE 1 | TARGET 1-3 | TACTICAL VEHICLE | 200m | 15 % | 7.5/18 | SUPPRESSIBLE |
| 2 | STRIKING DEVICE 2 | TARGET 2-3 | TACTICAL VEHICLE | 350 m | 20 % | 5/12 | SUPPRESSIBLE |
| 3 | STRIKING DEVICE 3 | TARGET 3-2 | TACTICAL VEHICLE | 600 m | 20 % | 5/15 | SUPPRESSIBLE |
| 4 | STRIKING DEVICE 2 | TARGET 2-1 | TACTICAL VEHICLE | 900m | 10 % | 10/12 | SUPPRESSIBLE |
| 5 | STRIKING DEVICE 1 | TARGET 1-2 | HUMAN | 1000 m | 10 % | 10/18 | SUPPRESSIBLE |
| 6 | STRIKING DEVICE 3 | TARGET 3-1 | HUMAN | 1300 m | 10 % | 10/15 | SUPPRESSIBLE |
| 7 | STRIKING DEVICE 3 | TARGET 3-3 | TACTICAL VEHICLE | 1500 m | 9 % | 11/15 | SUPPRESSIBLE |
| 8 | STRIKING DEVICE 2 | TARGET 2-2 | HUMAN | 2000 m | 5 % | 20/12 | NOT SUPPRESSIBLE |
| 9 | STRIKING DEVICE 1 | TARGET 1-1 | ARMORED VEHICLE | 1800 m | 5 % | 20/18 | NOT SUPPRESSIBLE |

APPARATUS AND METHOD FOR CONTROLLING STRIKING APPARATUS AND REMOTE CONTROLLED WEAPON SYSTEM

CROSS-REFERENCE TO RELATED APPLICATION

This application claims priority under 35 U.S.C. § 119 to Korean Patent Application No. 10-2018-0125841, filed on Oct. 22, 2018, in the Korean Intellectual Property Office, the disclosure of which is incorporated herein by reference in its entirety.

BACKGROUND

1. Field

Apparatuses and methods consistent with exemplary embodiments relate to an apparatus and method for controlling a striking device (e.g., an artillery device or gunnery device) and a remote-controlled weapon system employing the same, and more particularly, to a technology for controlling a striking device (e.g., an artillery device or gunnery device) to effectively aim a target based on the number of rounds of ammunition left in the striking device and an accuracy rate of the striking device.

2. Description of the Related Art

A remote-controlled weapon station (RCWS) or remote weapon station (RWS) is a system which is capable of remotely operating weapons (e.g., an artillery device or gunnery device). In the related art, the RCWS typically includes: i) a striking device which includes an imaging device for obtaining images of a weapon and a target where the striking device is mounted on a vehicle or a mobile robot; and ii) an operating system which remotely controls the striking device. In the related art, the operating system may be located inside a vehicle or at a remote place.

In the RCWS, a gunner or a soldier may remotely operate a weapon through a control device instead of manually operating the weapon itself. Therefore, the gunner can be protected from enemy attacks. In addition, precise targeting may be improved based on the performance of the imaging device.

In the related art, the striking device of the RCWS is generally loaded with a finite number of rounds of ammunition. Therefore, when the ammunition runs low during the firing of the striking device, new ammunition must be supplied to the striking device. In most situations where the striking device is used, such as battlefield and emergency situations, however, it is difficult to efficiently change out the ammunition.

Therefore, it is required to come up with an system that can help control the striking device to efficiently destroy, neutralize or dismantle a target using the limited amount of ammunition loaded in the striking device.

SUMMARY

Aspects of the present disclosure are directed to controlling a striking device to effectively destroy, neutralize or dismantle a target with limited ammunition.

However, aspects of the present disclosure are not restricted to the one set forth herein. The above and/or other aspects of the present disclosure will become more apparent to one of ordinary skill in the art to which the present disclosure pertains by referencing the detailed description of the present disclosure given below.

According to an aspect of the present disclosure, there is provided an apparatus for controlling a striking device equipped with a weapon to strike a target. The apparatus includes: a display unit which displays an image captured by a camera mounted on the striking device; a control unit which controls firing of the weapon; and a manipulation unit which transmits a fire signal to the control unit, wherein the control unit calculates the number of rounds of ammunition left in the striking device, calculates an accuracy rate which is a probability that the striking device will hit the target, and determines whether the target can be neutralized by considering the calculated number of rounds of ammunition left and the calculated accuracy rate for the target.

In an embodiment, the display unit may display the number of rounds of ammunition left, the accuracy rate, and whether the target can be neutralized.

In an embodiment, the control unit may calculate the number of rounds of ammunition left by comparing the number of rounds of ammunition initially loaded in the striking device with the number of rounds of ammunition fired which is measured by a measuring sensor mounted on the striking device.

In an embodiment, the control unit may calculate the accuracy rate for the target by considering stored parameters and calculated parameters.

In an embodiment, the stored parameters may include a shell dispersion of the weapon and a zeroing fire error of the weapon.

In an embodiment, the calculated parameters may include a distance between the striking device and the target, a size of the target, and moving speed of the target.

In an embodiment, the control unit may calculate the number of rounds of ammunition required based on the accuracy rate for the target and determine whether the target can be neutralized by comparing the number of rounds of ammunition left with the number of rounds of ammunition required.

In an embodiment, when there are a plurality of targets, the control unit may control the firing of the weapon by prioritizing the targets.

In an embodiment, the control unit may prioritize the targets based on whether each of the targets can be neutralized and the degree of threat posed by each of the targets.

In an embodiment, the control unit may calculate the degree of threat by considering a type of the target and the distance between the striking device and the target.

According to another aspect of the present disclosure, there is provided an apparatus for controlling a striking device equipped with a weapon to strike a target. The apparatus includes: a display unit which displays an image captured by a camera mounted on the striking device; a control unit which controls firing of the weapon; and a manipulation unit which transmits a fire signal to the control unit, wherein the control unit calculates the number of rounds of ammunition left in the striking device, calculates an accuracy rate which is a probability that the striking device will hit the target, determines whether the target can be neutralized by considering the calculated number of rounds of ammunition left and the calculated accuracy rate for the target, and, when there are a plurality of weapons, controls the firing of the weapons by allocating the target to one of the weapons.

The control unit may control the firing of the weapons by allocating the target in consideration of whether the target can be neutralized by each of the weapons and an accuracy rate of each of the weapons for the target.

According to another aspect of the present disclosure, there is provided a method of controlling a striking device equipped with a weapon to strike a target. The method includes: calculating an accuracy rate which is a probability that the striking device will hit the target; calculating the number of rounds of ammunition left in the striking device; calculating the number of rounds of ammunition required based on the calculated accuracy rate; determining whether the target can be neutralized by comparing the calculated number of rounds of ammunition required with the calculated number of rounds of ammunition left; and controlling firing of the weapon by considering the accuracy rate for the target, the number of rounds of ammunition left, the number of rounds of ammunition required, and whether the target can be neutralized.

In an embodiment, in the calculating of the number of rounds of ammunition left, the number of rounds of ammunition left may be calculated by comparing the number of rounds of ammunition initially loaded in the striking device with the number of rounds of ammunition fired which is measured by a measuring sensor mounted on the striking device.

In an embodiment, in the calculating of the accuracy rate, the accuracy rate for the target may be calculated by considering stored parameters and calculated parameters.

In an embodiment, in the controlling of the firing, when there are a plurality of targets, the firing of the weapon is controlled by prioritizing the targets.

In an embodiment, the targets may be prioritized based on whether each of the targets can be neutralized and the degree of threat posed by each of the targets.

In an embodiment, the degree of threat may be calculated by considering a type of the target and a distance between the striking device and the target.

In an embodiment, in the controlling of the firing, when there are a plurality of weapons, the firing of the weapons may be controlled by allocating the target to one of the weapons.

In an embodiment, in the controlling of the firing, the target may be allocated by considering whether the target can be neutralized by each of the weapons and an accuracy rate of each of the weapons for the target.

BRIEF DESCRIPTION OF THE DRAWINGS

The above and/or other aspects of the disclosure will become apparent and more readily appreciated from the following description of exemplary embodiments, taken in conjunction with the accompanying drawings in which:

FIGS. 4 and 5 illustrate an example in which a remote control apparatus for controlling a striking device according to an exemplary embodiment determines whether a target can be neutralized (or destroyed) when one weapon and one target are involved;

FIGS. 6 and 7 illustrate an example in which a remote control apparatus for controlling the striking device according to an exemplary embodiment determines whether a target can be neutralized (or destroyed) when there is one weapon and there are a plurality of targets to be hit;

FIGS. 8 and 9 illustrate an example in which a remote control apparatus for controlling the striking device according to an exemplary embodiment determines whether a target can be neutralized (or destroyed) when there are a plurality of weapons and there is only one target;

FIGS. 10 and 11 illustrate an example in which a remote control apparatus for controlling the striking device according to an exemplary embodiment determines whether a target can be neutralized (or destroyed) when there are a plurality of weapons and there are a plurality of targets.

DETAILED DESCRIPTION

Figure 1:
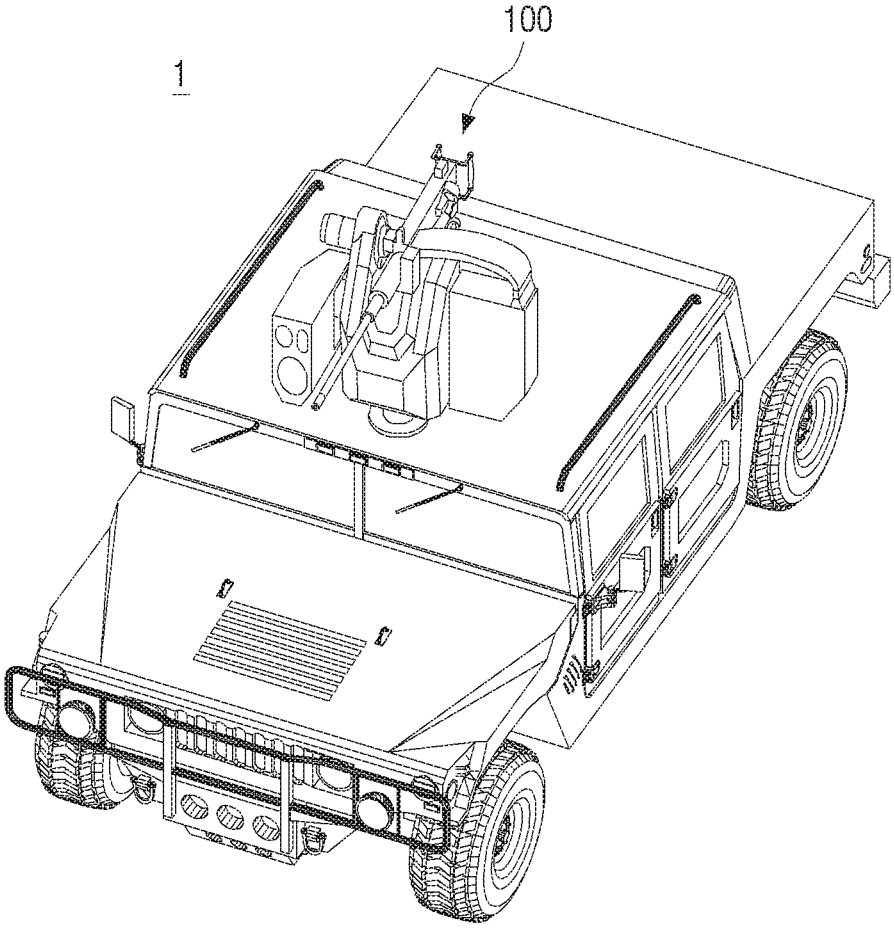
FIG. 1 illustrates a vehicle equipped with a striking device according to an exemplary embodiment.

Advantages and features of the disclosure and methods of accomplishing the same may be understood more readily by reference to the following detailed description of exemplary embodiments and the accompanying drawings. The disclosure may, however, be embodied in many different forms and should not be construed as being limited to the exemplary embodiments set forth herein. Rather, these exemplary embodiments are provided so that this disclosure will be thorough and complete and will fully convey the concept of the inventive concept to one of ordinary skill in the art, and the disclosure will only be defined by the appended claims. Like reference numerals refer to like elements throughout the specification.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular exemplary embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated element, but do not preclude the presence or addition of one or more other elements.

Hereinafter, an apparatus for controlling a striking device (e.g., an artillery device or gunnery device) according to an exemplary embodiment will be described with reference to FIGS. 1 through 11.

Figure 2:
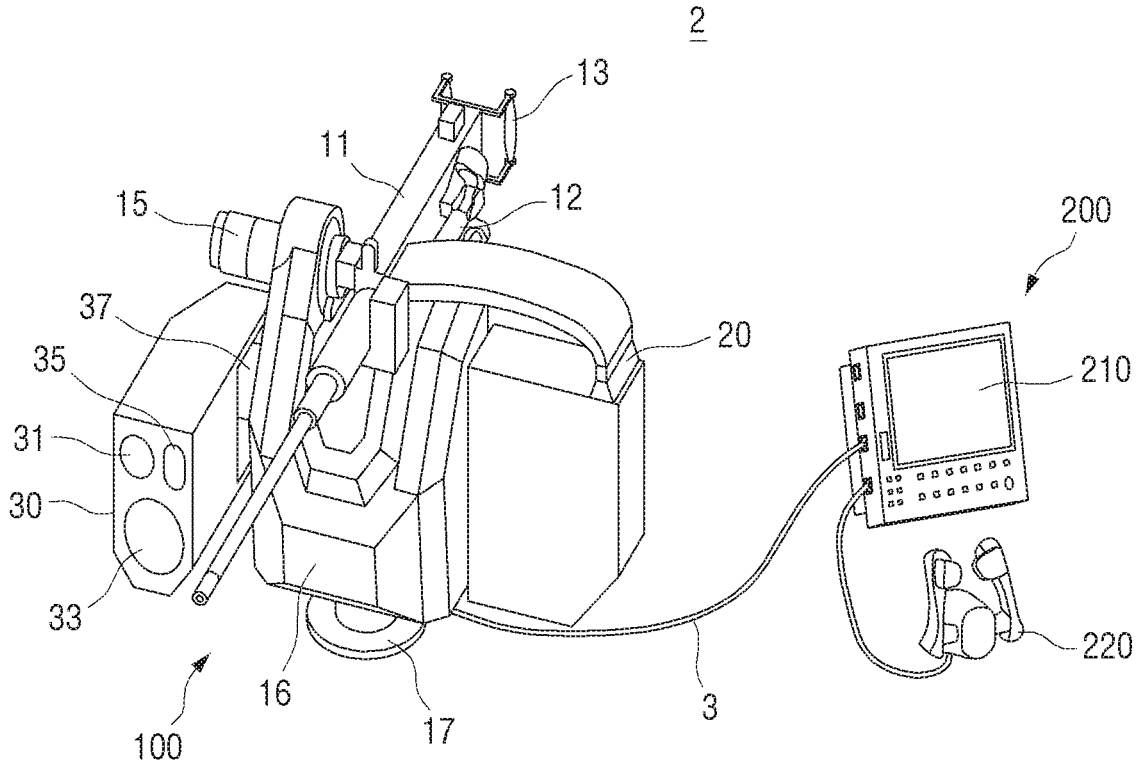
FIG. 2 illustrates a configuration of a remote-controlled weapon system including a striking device according to an exemplary embodiment.

FIG. 1 illustrates a vehicle 1 equipped with a striking device 100 according to an exemplary embodiment. FIG. 2 illustrates a configuration of a remote-controlled weapon system 2 including the striking device 100 according to an exemplary embodiment.

Referring to FIG. 1, the vehicle 1 equipped with the striking device 100 according to the exemplary embodiment is illustrated. In the remote-controlled weapon system 2 according to the exemplary embodiment, a striking device 100 is mounted on the exterior of the vehicle 1, and a remote control apparatus 200 for controlling the striking device 100 may be provided inside the vehicle 1 or at a remote place. In FIGS. 1 and 2, the remote-controlled weapon system 2 according to the exemplary embodiment is mounted on the vehicle 1. However, the remote-controlled weapon system 2 may also be mounted on an unmanned moving object such as a mobile robot or a stationary object such as an underground shelter (i.e., a bunker). In the description below, it will be assumed that the remote-controlled weapon system 2 according to the exemplary embodiment is mounted on the vehicle 1.

Referring to FIG. 2, the remote-controlled weapon system 2 according to the exemplary embodiment includes the striking device 100 and the remote control apparatus 200 for controlling the striking device 100. Here, the striking device 100 and the remote control apparatus 200 for controlling the striking device 100 are connected through a cable 3. However, the exemplary embodiment is not limited thereto and the striking device 100 and the remote control apparatus 200 may also be wirelessly connected.

The striking device 100 includes a weapon 11, a mount 12, a fitting solenoid 13, a vertical driving unit 15, a support unit 16, a horizontal driving unit 17, an ammunition supply unit 20, and a photographing unit 30.

The weapon 11 fires at a target. Specifically, the weapon 11 fires at the target according to a set firing mode. For example, when the set firing mode of the weapon 11 is a single-shot firing mode, the weapon 11 fires one shot at the target. In addition, when the firing mode of the weapon 11 is a point firing mode, the weapon 11 points to the target and fires multiple shots at the target. In addition, when the firing mode of the weapon 11 is a successive firing mode, the weapon 11 fires at the target several times in succession. In the disclosure, objects refer to objects that can be shot in an image captured by the photographing unit 30. In addition, a target refers to an object to be shot amongst the objects. That is, the objects include the target, and an object selected as the target is a target for shooting. The following description is based on this premise.

The weapon 11 is mounted on the mount 12, and the mount 12 is connected to the support unit 16.

The mount 12 is equipped with a measuring sensor for counting or determining the number of rounds of ammunition fired by the weapon 11. For example, the measuring sensor counts ten (10) when the number of rounds of ammunition fired by the weapon 11 is ten (10). The number of rounds of ammunition counted by the measuring sensor will be defined and described as the number of rounds of ammunition fired.

The support unit 16 is coupled to the vertical driving unit 15 and the horizontal driving unit 17. The support unit 16 is driven (i.e., rotated) upward or downward by the vertical driving unit 15 and is driven (i.e., rotated) to the left or right by the horizontal driving unit 17.

The fitting solenoid 13 is operated to fire the weapon 11. Accordingly, the weapon 11 is fired to shoot at a target.

The vertical driving unit 15 drives (i.e., rotates) the support unit 16 upward or downward. Here, a motor may be included in the vertical driving unit 15 to rotate the support unit 16 upward or downward. Accordingly, the weapon 11 can be rotated in an up-down direction to fire at a target. Here, the up-down direction denotes an up-down direction of a side toward which the muzzle of the weapon 11 points.

The horizontal driving unit 17 drives (i.e., rotates) the support unit 16 to the left or right. Here, a motor may be included in the horizontal driving unit 17 to rotate the support unit 16 to the left or right. Accordingly, the weapon 11 can be rotated in an up-down direction to fire at a target. Here, the left-right direction denotes a left-right direction of the side toward which the muzzle of the weapon 11 points.

The ammunition supply unit 20 is loaded with ammunition and supplies the loaded ammunition to the weapon 11.

The photographing unit 30 includes a daytime camera 31, a nighttime camera 33, a distance sensor 35, and a driver 37. The photographing unit 30 captures an image containing the objects to be shot by the weapon 11.

The daytime camera 31 is generally operated in a daytime to photograph the objects. However, it does not mean that the daytime camera 31 cannot be operated in a nighttime situation. That is, the daytime camera 31 can be operated not only in the daytime but also in the nighttime under the control of the remote control apparatus 200. Here, the daytime camera 31 may be a television (TV) camera.

The nighttime camera 33 is generally operated in the nighttime to photograph the objects. However, it does not mean that the nighttime camera 33 cannot be operated during the daytime. That is, the nighttime camera 33 can be operated not only in the nighttime but also in the daytime under the control of the remote control apparatus 200. Here, the nighttime camera 33 may be an infrared (IR) camera.

The distance sensor 35 measures distances between the objects and the striking device 100.

The driver 37 is connected to the support unit 16. The driver 37 may perform zeroing by adjusting the distance between the photographing unit 30 and the weapon 11 to make the photographing direction of the photographing unit 30 and the firing direction of the weapon 11 parallel to each other or intersect each other.

The remote control apparatus 200 for controlling the striking device 100 controls each element of the striking device 100 to facilitate the shooting of a target. The remote control apparatus 200 for controlling the striking device 100 will now be described below.

Figure 3:
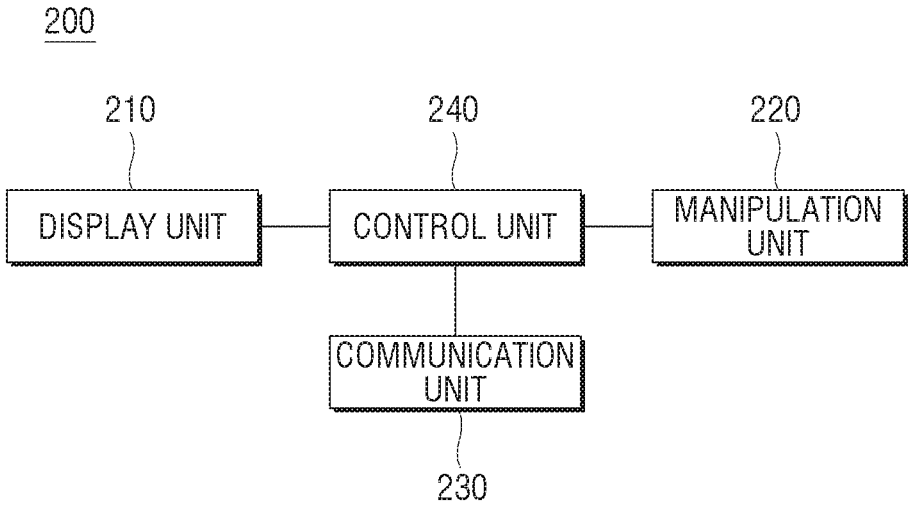
FIG. 3 is a block diagram of a remote control apparatus according to an exemplary embodiment.

FIG. 3 is a block diagram of a remote control apparatus 200 according to an exemplary embodiment.

Referring to FIG. 3, the remote control apparatus 200 for controlling the striking device 100 includes a display unit 210 (or a display 210), a manipulation unit 220 (or a transmitter 220), a communication unit 230 (or a transceiver 230), and the control unit 240 (or a controller 240).

The remote control apparatus 200 may be implemented as variety numbers hardware and/or software configurations executing certain functions. For example, the remote control apparatus 200 may denote a data processing device built in hardware, and includes a physically structured circuit for executing functions expressed as codes or commands included in a program.

More specifically, at least one of the components, elements, modules or units of remote control apparatus 200 in FIG. 3 may be embodied as various numbers of hardware, software and/or firmware structures that execute respective functions described above, according to an exemplary embodiment. For example, at least one of these components, elements, modules or units may use a direct circuit structure, such as a memory, a processor, a logic circuit, a look-up table, etc. that may execute the respective functions through controls of one or more microprocessors or other control apparatuses. Also, at least one of these components, elements, modules or units may be specifically embodied by a module, a program, or a part of code, which contains one or more executable instructions for performing specified logic functions, and executed by one or more microprocessors or other control apparatuses. Also, at least one of these components, elements, modules or units may further include or may be implemented by a processor such as a central processing unit (CPU) that performs the respective functions, a microprocessor, or the like. Two or more of these components, elements, modules or units may be combined into one single component, element, module or unit which performs all operations or functions of the combined two or more components, elements, modules or units. Also, at least part of functions of at least one of these components, elements, modules or units may be performed by another of these components, elements, modules or units. Further, although a bus is not illustrated in the above block diagrams, communication between the components, elements, modules or units may be performed through the bus. Functional aspects of the above exemplary embodiments may be implemented in algorithms that execute on one or more processors. Furthermore, the components, elements, modules or units represented by a block or processing steps may employ any number of related art techniques for electronics configuration, signal processing and/or control, data processing and the like.

The display unit 210 displays an image captured by the photographing unit 30. Specifically, the display unit 210 displays daytime and nighttime images captured by the daytime camera 31 and the nighttime camera 33 of the photographing unit 30 and displays information about the distance to a target measured by the distance sensor 35 of the photographing unit 30. In addition, the display unit 210 displays state information of the weapon 11, the target, etc. Here, the state information of the weapon 11 includes the number of rounds of remaining ammunition, an accuracy rate for the target, and information about whether the target can be neutralized. Here, in the disclosure (including the drawings), the term "neutralize" broadly includes the meaning of "disarm," "suppress," "destroy/dismantle," "debilitate," or "disable." Thus, the term, "suppressible" in the figures means "capable of being neutralized."

The manipulation unit 220 transmits control signals to the control unit 240. The control signals are signals for controlling the striking device 100 in response to a user's commands. Here, the user denotes a soldier or a gunner who is controlling the striking device 100.

The manipulation unit 220 may transmit a firing signal to the control unit 240 among the control signals. Specifically, the manipulation unit 220 may include a firing button. When the user presses the firing button, the firing signal may be transmitted to the control unit 240. When the user stops pressing the firing button, the manipulation unit 220 may stop transmitting the firing signal to the control unit 240.

In addition, the manipulation unit 220 may transmit a weapon operation signal to the control unit 240 amongst the control signals. Specifically, the manipulation unit 220 may include a weapon operation button for operating the weapon 11 upward, downward, to the left, or to the right. When the user presses the weapon operation button, the weapon operation signal may be transmitted to the control unit 240.

In addition, the manipulation unit 220 may transmit a photographing unit operation signal to the control unit 240 amongst the control signals. Specifically, the manipulation unit 220 may include a photographing unit operation button for operating the photographing unit 30 upward, downward, to the left, or to the right. When the user presses the photographing unit operation button, the photographing unit operation signal may be transmitted to the control unit 240.

The communication unit 230 transmits or receives data needed to control the weapon 11. The communication unit 230 may receive an image captured by the photographing unit 30, a distance measured by the distance sensor 35, and driving information of the weapon 11, the photographing unit 30 and the distance sensor 35. In addition, the communication unit 230 may receive operation signals generated by the control unit 240 and transmit the operation signals so that the weapon 11, the photographing unit 30, the distance sensor 35, etc. are operated according to the operation signals.

The communication unit 230 may transmit or receive data using wireless communication when the remote control apparatus 200 for controlling the striking device 100 is located at a remote place and may transmit or receive data using wired communication when the remote control apparatus 200 for controlling the striking device 100 is located inside a manned vehicle.

The control unit 240 controls the striking device 100 based on receiving the operation signals from the manipulation unit 220.

The control unit 240 calculates the number of rounds of ammunition remaining in the ammunition supply unit 20 of the striking device 100. Specifically, the control unit 240 compares the number of rounds of ammunition initially loaded in the ammunition supply unit 20 of the striking device 100 with the number of rounds of ammunition fired which is measured by the measuring sensor of the striking device 100 to calculate the number of remaining rounds of ammunition. For example, if the initial number of rounds of ammunition is 100 and the number of rounds of ammunition fired is 30, the control unit 240 calculates the number of remaining rounds of ammunition to be 70. That is, the control unit 240 calculates the number of remaining rounds of ammunition by subtracting the number of rounds of ammunition fired from the initial number of rounds of ammunition loaded in the ammunition supply unit 20.

The control unit 240 calculates the accuracy rate which is the probability that the striking device 100 will hit the target. Specifically, the control unit 240 calculates the accuracy rate for the target based on stored parameters and calculated parameters.

Here, the stored parameters include the shell dispersion of the weapon 11, an alignment error between the photographing unit 30 and the distance sensor 35, an alignment error between the photographing unit 30 and the weapon 11, a zeroing firing error of the weapon 11, and a driving error of the driver 37. That is, the stored parameters denote fixed parameters set from the initialization of the striking device 100 according to characteristics of the striking device 100.

In addition, the calculated parameters include the distance to the target, the moving speed of the target, and an aiming error for the target. That is, the calculated parameters denote variable parameters that vary in real time according to a change in the target.

The control unit 240 determines whether the target can be hit and neutralized based on the type of the target, the number of remaining rounds of ammunition, and the accuracy rate for the target.

Specifically, the control unit 240 first determines whether the target can be hit and neutralized with the weapon 11 mounted on the striking device 100 based on the type of the target. For example, when the type of the target is an armored vehicle and the weapon 11 is a rifle, the control unit 240 determines that the target cannot be neutralized with the given weapon. In another example, when the type of the target is a human and the weapon 11 is a rifle, the control unit 240 determines that the target can be hit and neutralized/killed. That is, the control unit 240 first determines whether the target can be neutralized/killed based on both the type of the target and the type of the weapon 11 being used to hit the target.

Then, when determining that the target can be neutralized with the weapon 11 mounted on the striking device 100 based on the type of the target, the control unit 240 calculates the number of rounds of ammunition required to neutralize the target based on the accuracy rate for the target and finally determines whether the target can be neutralized by comparing the number of remaining rounds of ammunition with the number of rounds of ammunition required to neutralize the target.

For example, if the accuracy rate for the target is 10% and the number of remaining rounds of ammunition is 11, 10 rounds of ammunition are required for at least one round fired from the weapon 11 to hit the target. Therefore, the number of rounds of ammunition required in this case is 10. Here, because the number of remaining rounds of ammunition is 11 which is larger than the number of rounds of ammunition required to hit and neutralize the target (based on the accuracy rate for the target), the control unit 240 determines that the target can be hit and neutralized.

In another example, if the accuracy rate for the target is 10% and the number of remaining rounds of ammunition is 9, 10 rounds of ammunition are required for at least one round fired from the weapon 11 to hit the target. Therefore, the number of rounds of ammunition required in this case is 10. Here, because the number of remaining rounds of ammunition (9) is smaller than the number of rounds of ammunition required to hit and neutralize the target, the control unit 240 determines that the target cannot be neutralized.

When there are a plurality of targets, the control unit 240 controls the firing of the weapon 11 by prioritizing the targets. Here, the control unit 240 prioritizes the targets by considering whether each of the targets can be hit and neutralized and the degree of threat posed by each of the targets. The degree of threat is calculated based on the type of each target and the distance between the striking device 100 and each target.

Specifically, the control unit 240 determines the priority of a target that can be neutralized amongst the targets to be higher than that of a target that cannot be neutralized based on the type of the target and the type of the weapon 11. When there are a plurality of targets that can be neutralized, the control unit 240 determines the priority of a target posing a high degree of threat to be higher than that of a target posing a low degree of threat.

When there are a plurality of weapons 11, the control unit 240 controls the firing of the weapons 11 by allocating a target to one of the weapons 11. Here, the control unit 240 allocates the target based on whether the target can be neutralized by each of the weapons 11 and based on the accuracy rate of each of the weapons 11 for the target.

Specifically, if the target can be neutralized by one of the weapons 11 but cannot be neutralized by another weapons 11, the control unit 240 allocates the target to the weapon that can neutralize the target. When all of the weapons 11 can destroy the target, the control unit 240 assigns the target to a weapon 11 with a higher accuracy rate.

A process in which the remote control apparatus 200 for controlling the striking device 100 determines whether a target can be neutralized according to a change in the number of targets and the number of weapons 11 will be described in detail.

Figure 4:
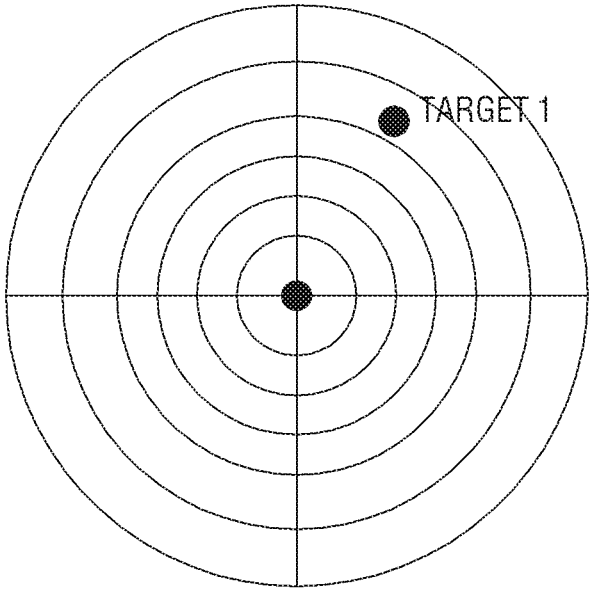

FIGS. 4 and 5 illustrate an example in which a remote control apparatus 200 for controlling the striking device 100 according to the exemplary embodiment determines whether a target can be neutralized when one weapon and one target are involved.

Referring to FIG. 4, when "Target 1" is detected by the striking device 100, it is displayed on the display unit 210.

In addition, referring to FIG. 5, the priority of "Target 1", target information, the distance to target, the accuracy rate of the striking device 100 for "Target 1", the number of rounds of ammunition required, the number of remaining rounds of ammunition, and determination on whether the target can be neutralized are displayed on the display unit 210.

Specifically, because there is one weapon 11 and there is one target, i.e., "Target 1" in FIG. 5, the priority of "Target 1" is 1 (i.e., the top priority). In addition, the target information is detected to be "Target 1" and a human. Here, there may be various types of target information such as an armored vehicle and a tactical vehicle besides a human. In addition, the distance to target is detected to be 190 m.

In FIG. 5, because the accuracy rate of the weapon 11 is 20%, the number of rounds of ammunition required is five (5), and the number of remaining rounds of ammunition is ten (10), the control unit 240 determines that "Target 1" can be neutralized.

Figure 6:
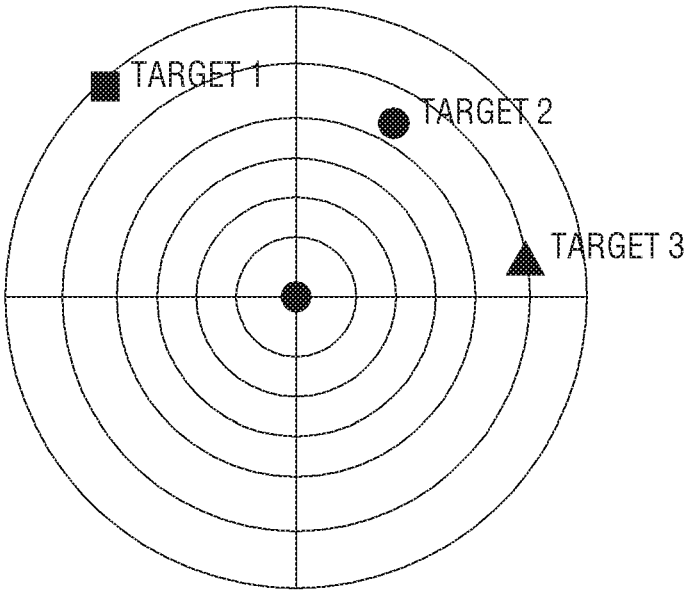

FIGS. 6 and 7 illustrate an example in which a remote control apparatus 200 for controlling the striking device 100 according to the exemplary embodiment determines whether a target can be neutralized when there is one weapon and there are a plurality of targets to be hit.

Referring to FIG. 6, when "Target 1", "Target 2" and "Target 3" are detected by the striking device 100, the targets are displayed on the display unit 210.

In addition, referring to FIG. 7, the priority of each of "Target 1", "Target 2" and "Target 3", target information, the distance to target, the accuracy rate of the striking device 100, the number of rounds of ammunition required, the number of remaining rounds of ammunition, and determination on whether each target can be neutralized are displayed on the display unit 210.

Specifically, although there is only one weapon 11, there are three targets, i.e., "Target 1", "Target 2" and "Target 3" in FIG. 7. Therefore, the priority of each of the three targets is determined based on whether each of the targets can be neutralized and the degree of threat posed by each of the targets. That is, because "Target 1" cannot be neutralized, the priority of "Target 1" is determined to be 3 among the three targets. While both "Target 2" and "Target 3" can be neutralized, the degree of threat posed by "Target 2" is higher than the degree of threat posed by "Target 3" based on, for example, the distance to target and target information. Therefore, the priority of "Target 2" is determined to be 1 (top priority), and the priority of "Target 3" is determined to be 2 (second priority). In addition, the target information is detected to be an armored vehicle in the case of "Target 1", a tactical vehicle in the case of "Target 2", and a human in the case of "Target 3". Also, the distance to target is detected to be 2000 m in the case of "Target 1", 500 m in the case of target 2, and 1200 m in the case of "Target 3".

In FIG. 7, the accuracy rate of the weapon 11 is 5% for "Target 1", 20% for "Target 2" and 15% for "Target 3", the number of rounds of ammunition required is twenty (20) for "Target 1", five (5) for "Target 2" and 7.5 for "Target 3", and the number of remaining rounds of ammunition is ten (10). Therefore, the control unit 240 determines that "Target 1" cannot be neutralized, but "Target 2" and "Target 3" can be neutralized.

Figure 8:
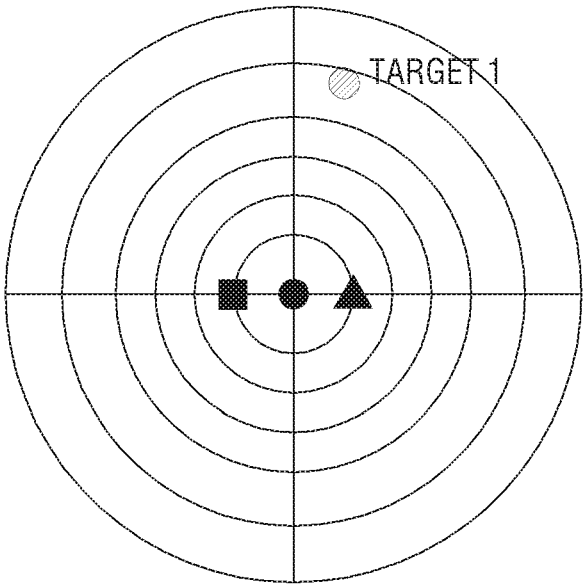

FIGS. 8 and 9 illustrate an example in which the remote control apparatus 200 for controlling the striking device 100 according to the exemplary embodiment determines whether a target can be neutralized when there are a plurality of weapons and there is only one target.

Referring to FIG. 8, when "Target 1" is detected by the striking device 100, it is displayed on the display unit 210.

In addition, referring to FIG. 9, the priority of "Target 1", target information, the distance to target, the accuracy rate of each of striking devices 1 through 3, the number of rounds of ammunition required, the number of remaining rounds of ammunition, and determination on whether the target can be neutralized are displayed on the display unit 210.

Specifically, although three weapons 11 are available, there is only one target, i.e., "Target 1" in FIG. 9. Therefore, the priority of "Target 1" is determined to be 1 (top priority) for all weapons 11. In addition, the target information of "Target 1" is detected to be a tactical vehicle, and the distance to target of "Target 1" is detected to be 200 m.

In FIG. 9, the accuracy rate of striking device 1 is 10% for "Target 1", the accuracy rate of striking device 2 is 20% for "Target 1", the accuracy rate of striking device 3 is 5% for "Target 1", the number of rounds of ammunition required by striking device 1 is ten (10) for "Target 1", the number of rounds of ammunition required by striking device 2 is five (5) for "Target 1", the number of rounds of ammunition required by striking device 3 is twenty (20) for "Target 1", and the number of remaining rounds of ammunition is fifteen (15). Therefore, the control unit 240 determines that "Target 1" cannot be neutralized by striking device 3, but can be neutralized by either striking device 1 or striking device 2.

Figure 10:
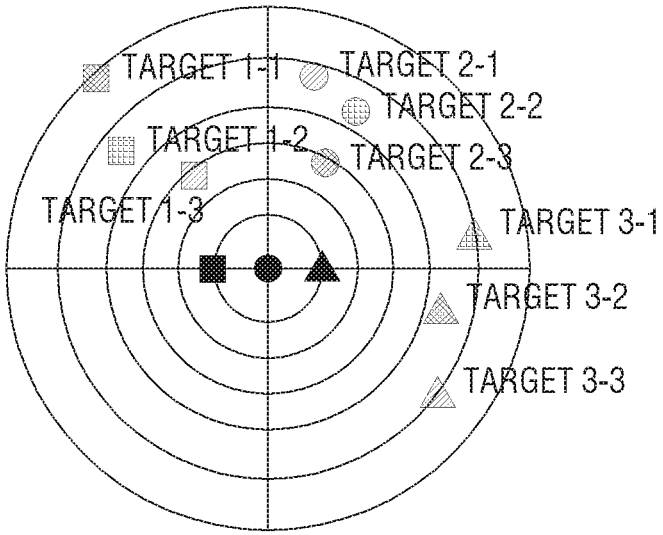

FIGS. 10 and 11 illustrate an example in which a remote control apparatus 200 for controlling the striking device 100 according to the exemplary embodiment determines whether a target can be neutralized when there are a plurality of weapons and there are a plurality of targets.

Referring to FIG. 10, when "Target 1-1" through "Target 3-3" are detected by the striking device 100, they are displayed on the display unit 210.

In addition, referring to FIG. 11, the priority of each of "Target 1-1" through "Target 3-3," target information, the distance to target, the accuracy rate of each of striking devices 1 through 3, the number of rounds of ammunition required, the number of remaining rounds of ammunition, and determination on whether each target can be neutralized are displayed on the display unit 210.

Specifically, because there are three weapons 11 and nine targets in FIG. 11, the priority of each of the targets is determined based on whether each target can be neutralized and the degree of threat posed by each target. That is, because "Target 1-1" and "Target 2-2" cannot be neutralized, the priority of "Target 1-1" and the priority of "Target 2-2" are determined to be 8 and 9 amongst the nine targets. As the other targets can be neutralized, these targets are prioritized from 1 to 7 according to the degree of threat posed by respective target. In addition, the target information is detected to be an armored vehicle in the case of "Target 1-1", a tactical vehicle in each of "Target 1-3," "Target 2-1," "Target 2-3," "Target 3-2" and "Target 3-3," and a human in each of "Target 2-2" and "Target 3-1." Also, the distance to target is detected to be 200 m in the case of "Target 1-3," 350 m in the case of "Target 2-3," 600 m in the case of "Target 3-2," 900 m in the case of "Target 2-1," 1000 m in the case of "Target 1-2," 1300 m in the case of "Target 3-1," 1500 m in the case of "Target 3-3," 2000 m in the case of "Target 2-2," and 1800 m in the case of "Target 1-1."

In FIG. 11, the accuracy rate of striking device 1 is 15% for "Target 1-3," 10% for "Target 1-2" and 5% for "Target 1-1," the accuracy rate of striking device 2 is 20% for "Target 2-3," 10% for "Target 2-1" and 5% for "Target 2-2," the accuracy rate of striking device 3 is 20% for "Target 3-2," 10% for "Target 3-1" and 9% for "Target 3-3," the number of rounds of ammunition required by striking device 1 is 7.5 for "Target 1-3," 10 for "Target 1-2" and 20 for "Target 1-1," the number of rounds of ammunition required by striking device 2 is 5 for "Target 2-3," 10 for "Target 2-1" and 20 for "Target 2-2," the number of rounds of ammunition required by striking device 3 is 5 for "Target 3-2," 10 for "Target 3-1" and 11 for "Target 3-3," the number of remaining rounds of ammunition is 18 in the case of striking device 1, 12 in the case of striking device 2 and 15 in the case of striking device 3. Therefore, the control unit 240 determines that "Target 1-1" and "Target 2-2" cannot be neutralized, but the other targets can be neutralized.

A method of controlling a striking device according to an exemplary embodiment will now be described with reference to FIG. 12. Here, a description of elements and features identical to those described above with reference to FIGS. 1 through 11 will be omitted.

Figure 12:
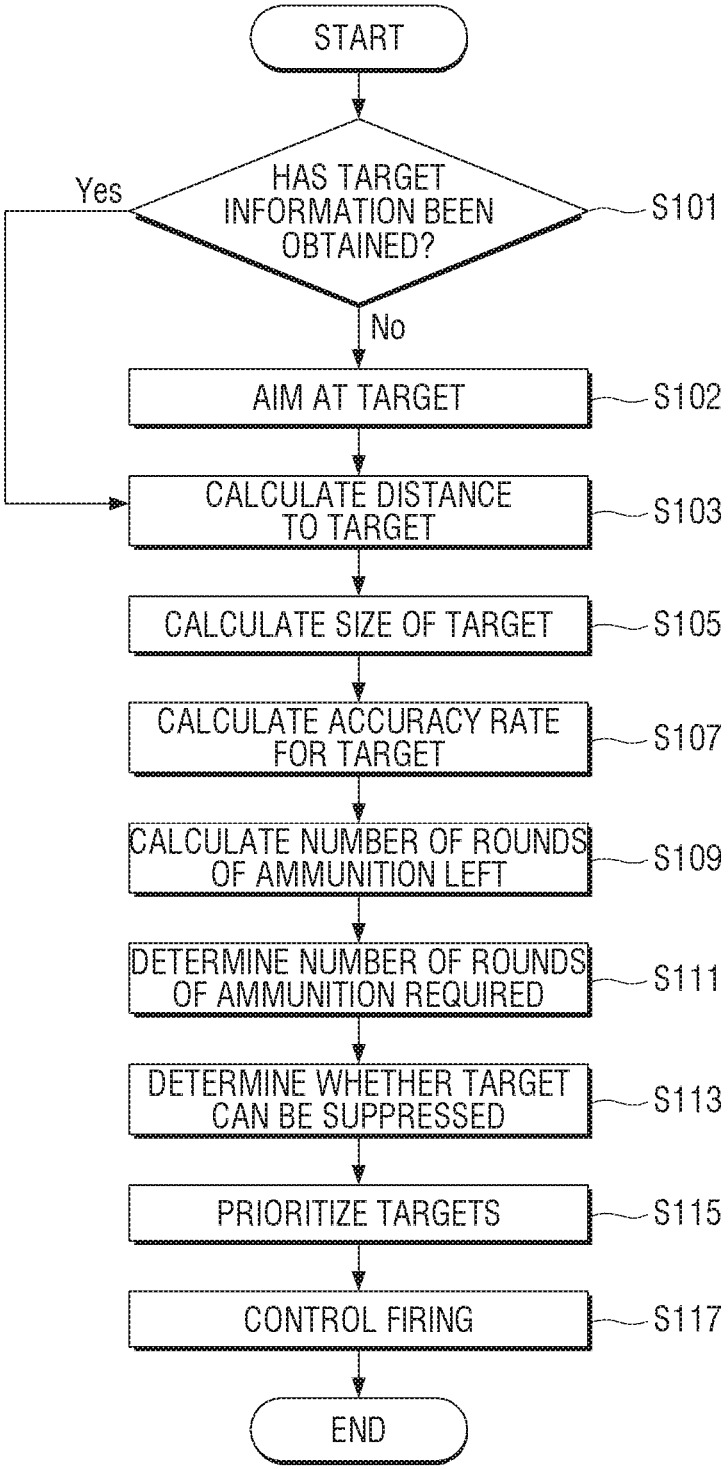
FIG. 12 is a flowchart sequentially illustrating a control method used by an apparatus for controlling a striking device according to an embodiment.

FIG. 12 is a flowchart sequentially illustrating a control method used by an apparatus for controlling a striking device according to an exemplary embodiment.

Referring to FIG. 12, a control unit 240 (or a controller) determines whether target information has been obtained from a system linked with a remote control apparatus 200 for controlling a striking device 100 through a network (operation S101). Here, the target information includes the latitude and longitude, military coordinates, altitude, type, etc. of a target.

Then, if the target information is not obtained in operation S101, the control unit 240 aims at the target by controlling a photographing unit 30 (operation S102).

Next, the control unit 240 calculates the distance to the target based on the target information obtained in operation S101 or measures the distance to the target aimed at in operation S102 (operation S103).

Next, the control unit 240 calculates the size of the target (operation S105).

Next, the control unit 240 calculates an accuracy rate for the target by considering the size of the target calculated in operation S103 and the size of the target calculated in operation S105. Here, the control unit 240 calculates the accuracy rate for the target by considering all calculated parameters and stored parameters in addition to the size of the target and the distance to the target as described above.

Next, the control unit 240 calculates the number of rounds of remaining ammunition in the striking device 100 (operation S109).

Next, the control unit 240 calculates the number of rounds of ammunition required based on the accuracy rate for the target calculated in operation S105.

Next, the control unit 240 compares the number of remaining rounds of ammunition with the number of rounds of ammunition required to determine whether the target can be neutralized (operation S113). Here, when there are a plurality of weapons 11, the control unit 240 allocates the target to one of the weapons 11 and determines whether the target can be neutralized.

Next, when there are a plurality of targets, the control unit 240 prioritize the targets (operation S115).

Next, the control unit 240 controls the firing of the weapon 11 (operation S117).

The present disclosure can prevent waste of ammunition by calculating whether a target can be neutralized in consideration of the number of remaining rounds of ammunition in a striking device and an accuracy rate of the striking device.

In addition, when there are a plurality of targets, the present disclosure prioritizes the targets by considering the number of remaining rounds of ammunition and the degree of threat posed by each of the targets. Therefore, the striking device can be efficiently operated.

Furthermore, when there are a plurality of striking devices, the present disclosure starts firing after allocating a target to one of the striking devices. Therefore, the target can be more efficiently eliminated.

However, the effects of the exemplary embodiments are not restricted to the one set forth herein. The above and other effects of the exemplary embodiments will become more apparent to one of daily skill in the art to which the exemplary embodiments pertain by referencing the claims.

While exemplary embodiments have been particularly shown and described above, it will be understood by those of ordinary skill in the art that various changes in form and detail may be made therein without departing from the spirit and scope of the present disclosure as defined by the following claims.

What is claimed is:

1. An apparatus for controlling a striking device equipped with at least one weapon to strike a target, the apparatus comprising:

a display configured to display an image captured by a camera provided on the striking device; and a controller configured to control firing of the at least one weapon, wherein the controller is configured to calculate a number of remaining rounds of ammunition in the striking device, configured to calculate an accuracy rate of the striking device corresponding to a probability of the striking device hitting the target, and configured to determine whether the target is capable of being neutralized based on the calculated number of remaining rounds of ammunition and the calculated accuracy rate.

2. The apparatus of claim 1, wherein the display is configured to display the number of remaining rounds of ammunition, the accuracy rate, and whether the target is capable of being neutralized.

3. The apparatus of claim 1, wherein the controller is configured to calculate the number of remaining rounds of ammunition based on a number of rounds of ammunition initially loaded in the striking device with a number of rounds of ammunition fired.

4. The apparatus of claim 1, wherein the controller is configured to calculate the accuracy rate for the target based on stored parameters and calculated parameters.

5. The apparatus of claim 4, wherein the stored parameters comprise:

a shell dispersion of the at least one weapon; and a zeroing fire error of the at least one weapon.

6. The apparatus of claim 4, wherein the calculated parameters comprise:

a distance between the striking device and the target;

a size of the target; and moving speed of the target.

7. The apparatus of claim 1, wherein the controller is further configured to calculate a number of rounds of ammunition required to neutralize the target based on the accuracy rate for the target, and wherein the controller is further configured to determine whether the target is capable of being neutralized based on the number of remaining rounds of ammunition with the number of rounds of ammunition required to neutralize the target.

8. The apparatus of claim 1, wherein based on there being a plurality of targets, the controller is configured to control the firing of the at least one weapon based on prioritization of the plurality of targets.

9. The apparatus of claim 8, wherein the controller is configured to prioritize the plurality of targets based on whether each of the plurality of targets is capable of being neutralized and a degree of threat posed by each of the plurality of targets.

10. The apparatus of claim 9, wherein the controller is further configured to calculate the degree of threat based on a type of the target and a distance between the striking device and the target.

11. The apparatus of claim 1, wherein the at least one weapon comprises a plurality of weapons to strike the target, wherein the controller is configured to control firing each weapon of the plurality of weapons, wherein the controller is configured to calculate a number of remaining rounds of ammunition in each weapon, configured to calculate an accuracy rate corresponding to a probability of each weapon hitting the target and configured to determine whether the target is capable of being neutralized by each weapon based on the calculated remaining number of rounds of ammunition and the calculated accuracy rate for the target, and wherein the controller is further configured to allocate one of the plurality of weapons to neutralize the target.

12. The apparatus of claim 11, wherein the controller is configured to allocate the one of the plurality of weapons to neutralize the target based on whether the target is capable of being neutralized by each weapon and the calculated accuracy rate of each weapon for the target.

13. A method of controlling a striking device including a weapon to strike a target, the method comprising:

calculating an accuracy rate of the striking device corresponding to a probability of the striking device hitting the target;

calculating a number of remaining rounds of ammunition in the striking device;

calculating a number of rounds of ammunition required to hit the target based on the calculated accuracy rate;

determining whether the target is capable of being neutralized based on the calculated number of rounds of ammunition required and the calculated number of remaining rounds of ammunition; and controlling firing of the weapon based on the accuracy rate for the target, the number of remaining rounds of ammunition, the number of rounds of ammunition required, and whether the target is capable of being neutralized.

14. The method of claim 13, wherein, in the calculating the number of remaining rounds of ammunition, the number of remaining rounds of ammunition is calculated based on a number of rounds of ammunition initially loaded in the striking device and a number of rounds of ammunition fired.

15. The method of claim 13, wherein, in the calculating the accuracy rate, the accuracy rate for the target is calculated based on stored parameters and calculated parameters.

16. The method of claim 13, wherein, in the controlling the firing, based on there being a plurality of targets, the controlling the firing comprises prioritizing the targets.

17. The method of claim 16, wherein the prioritizing the targets comprises prioritizing the targets based on whether each target of the plurality of targets is capable of being neutralized and a degree of threat posed by each target.

18. The method of claim 17, wherein the degree of threat is calculated based on a type of the target and a distance between the striking device and the target.

19. The method of claim 13, wherein, in the controlling the firing, based on there being a plurality of weapons, controlling the firing comprises allocating the target to one of the plurality of weapons.

20. The method of claim 19, wherein, in the controlling the firing, the target is allocated based on whether the target is capable of being neutralized by each weapon and an accuracy rate of each weapon for the target.

21. An apparatus for controlling a striking device equipped with a plurality of weapons to strike a plurality of targets, the apparatus comprising:

a display configured to display an image captured by a camera provided on the striking device; and a controller configured to control firing of each of the plurality of weapons, wherein the controller is configured to calculate a number of remaining rounds of ammunition in each weapon, configured to calculate an accuracy rate of each weapon corresponding to a probability of each weapon hitting each target, and configured to determine whether each of the plurality of targets is capable of being neutralized based on the calculated number of remaining rounds of ammunition in each weapon and the calculated accuracy rate of each weapon.

22. The apparatus of claim 21, wherein the display is configured to display the number of remaining rounds of ammunition of each weapon, the accuracy rate of each weapon, and whether each of the plurality of targets is capable of being neutralized.

23. The apparatus of claim 21, wherein the controller is configured to calculate the number of remaining rounds of ammunition of each weapon based on a number of rounds of ammunition initially loaded each weapon with a number of rounds of ammunition fired by each weapon.

24. The apparatus of claim 21, wherein the controller is configured to calculate the accuracy rate of each weapon based on stored parameters and calculated parameters.

25. The apparatus of claim 24, wherein the stored parameters comprise:

a shell dispersion of the weapon; and a zeroing fire error of the weapon.

26. The apparatus of claim 24, wherein the calculated parameters comprise:

a distance between the striking device and the target;

a size of the target; and moving speed of the target.

27. The apparatus of claim 21, wherein the controller is further configured to prioritize the plurality of targets based on whether each target is capable of being neutralized and a degree of threat posed by each target.

28. The method of claim 27, wherein the degree of threat is calculated based on a type of each target and a distance between the striking device and the target.

* * * * *